US006550075B1

(12) United States Patent
Brannon, III

(10) Patent No.: US 6,550,075 B1
(45) Date of Patent: Apr. 22, 2003

(54) TOILET BOWL SPLASH GUARD

(76) Inventor: Homer Brannon, III, 2455 NW. 98th St., Miami, FL (US) 33147

( * ) Notice: Subject to any disclaimer, the term of this patent is extended or adjusted under 35 U.S.C. 154(b) by 0 days.

(21) Appl. No.: 10/104,950

(22) Filed: Mar. 25, 2002

(51) Int. Cl.[7] ..... E03D 9/00

(52) U.S. Cl. ..... 4/300.3; 4/DIG. 5

(58) Field of Search ..... 4/300.3, DIG. 5

(56) References Cited

U.S. PATENT DOCUMENTS 2,839,764 A * 6/1958 Gardner ..... 4/300.3 X
5,983,410 A * 11/1999 Webster ..... 4/300.3

FOREIGN PATENT DOCUMENTS

JP 0261137 * 10/1990 ..... 4/300.3

* cited by examiner

*Primary Examiner*—Charles E. Phillips

(57) ABSTRACT

A toilet bowl splash guard for preventing splattering about the toilet when the user is going to the bathroom. The toilet bowl splash guard includes a support member being adapted to be attached to an underside of a toilet seat; and also includes an upper sheet of material having a top end which is securely attached to the support member; and further includes a hinge member being attached to a bottom end of the upper sheet of material; and also includes a lower sheet of material being attached to the hinge member and being adapted to extend into a toilet bowl; and further includes side sheets of material being attached to the upper and lower sheets of material to form side walls to prevent splattering to sides of the toilet; and also includes a fastening member for fastening one of the sheets of material to the toilet bowl.

9 Claims, 2 Drawing Sheets

TOILET BOWL SPLASH GUARD

BACKGROUND OF THE INVENTION

1. Field of the Invention

The present invention relates to splash guards for toilet bowls and more particularly pertains to a new toilet bowl splash guard for preventing splattering about the toilet when the user is going to the bathroom.

2. Description of the Prior Art

The use of splash guards for toilet bowls is known in the prior art. More specifically, splash guards for toilet bowls heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,348,776; 5,216,760; 5,983,410; 5,732,416; 2,839,764; 4,912,784; U.S. Pat. No. Des. 353,659; and U.S. Pat. No. 4,866,793.

While these devices fulfill their respective, particular objectives and requirements, the aforementioned patents do not disclose a new toilet bowl splash guard. The prior art describes inventions having panels protecting the back of the toilet.

SUMMARY OF THE INVENTION

The general purpose of the present invention, which will be described subsequently in greater detail, is to provide a new toilet bowl splash guard which has many of the advantages of the splash guards for toilet bowls mentioned heretofore and many novel features that result in a new toilet bowl splash guard which is not anticipated, rendered obvious, suggested, or even implied by any of the prior art splash guards for toilet bowls, either alone or in any combination thereof. The present invention includes a support member being adapted to be attached to an underside of a toilet seat; and also includes an upper sheet of material having a top end which is securely attached to the support member; and further includes a hinge member being attached to a bottom end of the upper sheet of material; and also includes a lower sheet of material being attached to the hinge member and being adapted to extend into a toilet bowl; and further includes side sheets of material being attached to the upper and lower sheets of material to form side walls to prevent splattering to sides of the toilet; and also includes a fastening member for fastening one of the sheets of material to the toilet bowl. None of the prior art describes splash guards having side walls to prevent the splattering of urine to the sides of the toilet.

There has thus been outlined, rather broadly, the more important features of the toilet bowl splash guard in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new toilet bowl splash guard which has many of the advantages of the splash guards for toilet bowls mentioned heretofore and many novel features that result in a new toilet bowl splash guard which is not anticipated, rendered obvious, suggested, or even implied by any of the prior art splash guards for toilet bowls, either alone or in any combination thereof.

Still another object of the present invention is to provide a new toilet bowl splash guard for preventing splattering about the toilet when the user is going to the bathroom.

Still yet another object of the present invention is to provide a new toilet bowl splash guard that is easy and convenient to set up and use.

Even still another object of the present invention is to provide a new toilet bowl splash guard that does not hinder the user of the toilet in any way and also effectively not only protects the back of the toilet but also to the sides thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
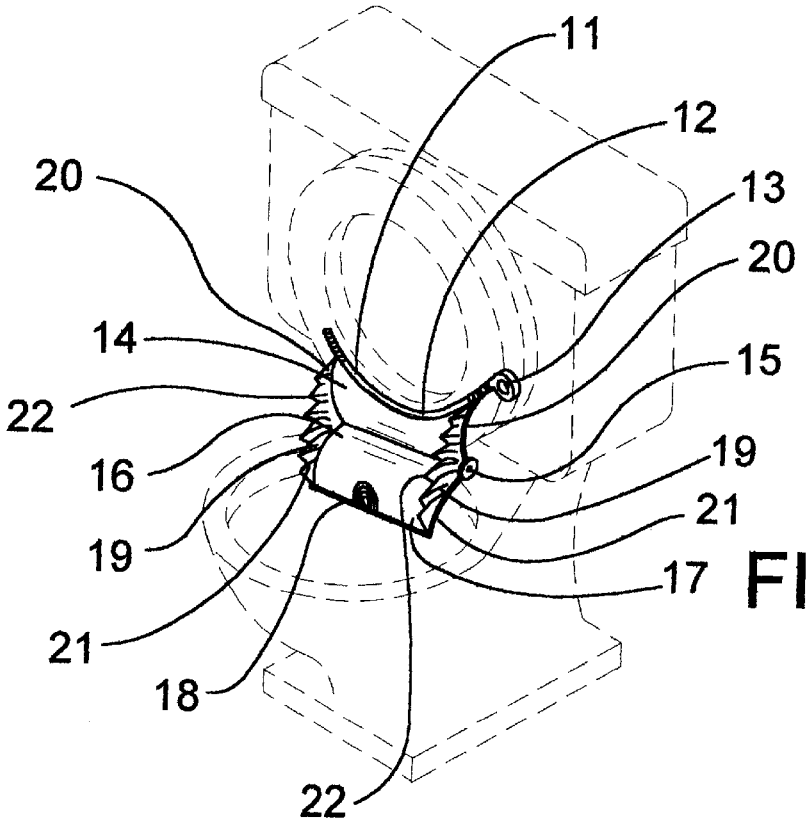
FIG. 1 is a perspective view of a new toilet bowl splash guard according to the present invention and shown in use.
Figure 2:
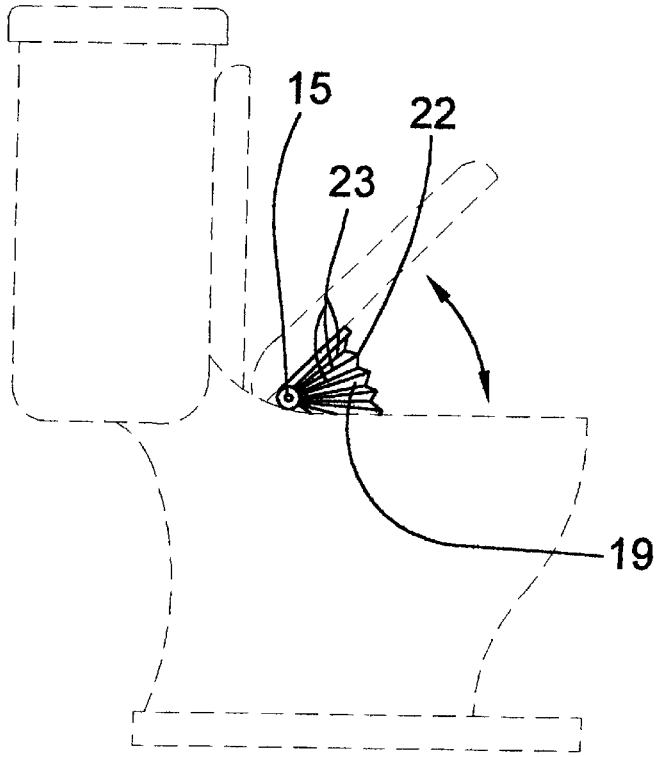
FIG. 2 is a side elevational view of the present invention shown in use.
Figure 3:
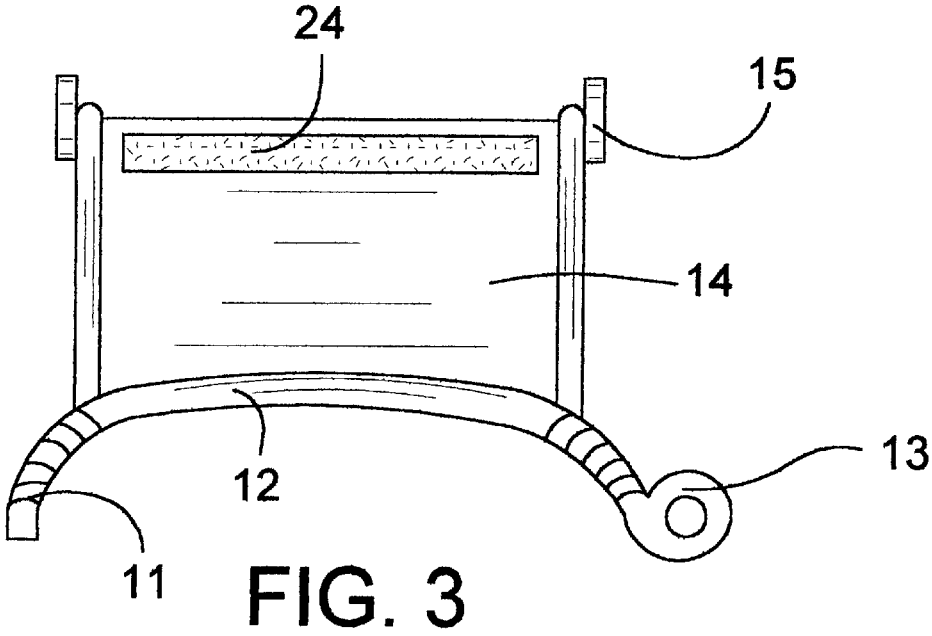
FIG. 3 is a top plan view of the present invention.
Figure 4:
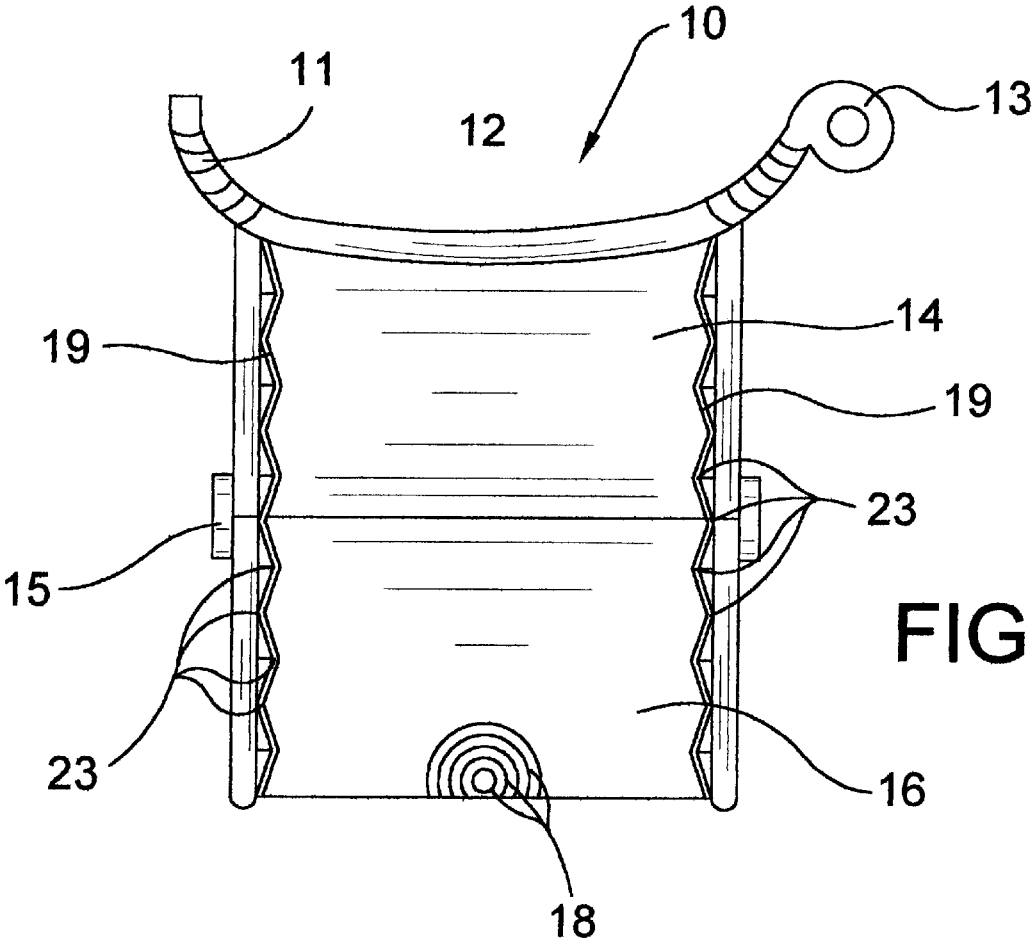
FIG. 4 is a front elevational view of the present invention.

With reference now to the drawings, and in particular to FIGS. 1 through 4 thereof, a new toilet bowl splash guard embodying the principles and concepts of the present invention and generally designated by the reference numeral 10 will be described.

As best illustrated in FIGS. 1 through 4, the toilet bowl splash guard 10 generally comprises a support member 11 being adapted to be fastenably attached to an underside of a toilet seat. The support member 11 includes a longitudinally-curved elongate member 12, and also includes an eyelet 13 being securely and integrally attached to an end of the longitudinally-curved elongate member 12 and being adapted to receive a fastener for fastening the support member 11 to the underside of the toilet seat. An upper sheet of material 14 has a top end which is securely and conventionally attached to the support member 11. A hinge member 15 is securely and conventionally attached to a bottom end of the upper sheet of material 14.

A lower sheet of material 16 is securely and conventionally attached to the hinge member 15 and is adapted to extend into a toilet bowl. The lower sheet of material 16 has a top end which is securely and conventionally attached to the hinge member 15 and is generally conventionally joined to the bottom end of the upper sheet of material 16 to prevent splattering of and about the toilet with urine. The lower sheet of material 16 has a lower portion 17 which is adapted to extend into the toilet bowl. The lower sheet of material 16 has a plurality of concentric arcs 18 being conventionally displayed upon a front side and along a bottom edge of the lower sheet of material 16.

A pair of side sheets of material 19 are securely and conventionally attached to the upper and lower sheets of material 14,16 to form side walls to prevent splattering of urine to sides of the toilet. Each of the side sheets of material 19 has a first inner side edge 20 which is securely and conventionally attached to a respective side edge of the upper sheet of material 14, and also has a second inner side edge 21 which is securely and conventionally attached to a respective side edge of the lower sheet of material 16. The first inner side edge 20 is angled relative to the second inner side edge 21 for each of the side sheets of material 19. Each of the side sheets of material 19 further has a plurality of pleats 23 being spaced apart and extending from the first and second inner side edges 20,21 to an outer side edge 22 thereof. Each of the side sheets of material 19 is accordion-like foldable along a length thereof. A fastening member 24 for fastening one of the upper and lower sheets of material 14,16 to the toilet bowl includes a strip of adhesive.

In use, the user lifts the toilet seat of the toilet which unfolds the side sheets of material 19 to form side walls. As the user is urinating the side sheets of material 19 and the upper and lower sheets of material 14,16 prevent the splattering of the urine to the back and to the sides of the toilet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the toilet bowl splash guard. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet bowl splash guard comprising:

a support member being adapted to be attached to an underside of a toilet seat;

an upper sheet of material having a top end which is securely attached to said support member;

a hinge member being attached to a bottom end of said upper sheet of material;

a lower sheet of material being attached to said hinge member and being adapted to extend into a toilet bowl;

side sheets of material being attached to said upper and lower sheets of material to form side walls to prevent splattering of urine to sides of the toilet; and a fastening member for fastening one of said upper and lower sheets of material to the toilet bowl.

2. A toilet bowl splash guard as described in claim 1, wherein said support member includes a longitudinally-curved elongate member, and also includes an eyelet being securely attached to an end of said longitudinally-curved elongate member and being adapted to receive a fastener for fastening said support member to the underside of the toilet seat.

3. A toilet bowl splash guard as described in claim 1, wherein said lower sheet of material has a top end which is securely attached to said hinge member and is generally joined to said bottom end of said upper sheet of material to prevent splattering of the toilet.

4. A toilet bowl splash guard as described in claim 3, wherein said lower sheet of material has a lower portion which is adapted to extend into the toilet bowl.

5. A toilet bowl splash guard as described in claim 4, wherein said lower sheet of material has a plurality of concentric arcs being displayed upon a front side and along a bottom edge of said lower sheet of material.

6. A toilet bowl splash guard as described in claim 1, wherein each of said side sheets of material has a first inner side edge which is securely attached to a respective side edge of said upper sheet of material, and also has a second inner side edge which is securely attached to a respective side edge of said lower sheet of material.

7. A toilet bowl splash guard as described in claim 6, wherein said first inner side edge is angled relative to said second inner side edge for each of said side sheets of material.

8. A toilet bowl splash guard as described in claim 7, wherein each of said side sheets of material further has a plurality of pleats being spaced apart and extending from said first and second inner side edges to an outer side edge thereof, each of said side sheets of material being accordion-like foldable along a length thereof.

9. A toilet bowl splash guard as described in claim 1, wherein said fastening member is a strip of adhesive.

* * * * *